United States Patent [19]

Ayache et al.

[11] 4,222,706

[45] Sep. 16, 1980

[54] POROUS ABRADABLE SHROUD WITH TRANSVERSE PARTITIONS

[75] Inventors: Michel R. Ayache, Epinay sous Senart; Pierre A. Glowacki, Melun; Gerard M. F. Mandet, Epinay sous Senart, all of France

[73] Assignee: Societe Nationale d'Etude et de Construction de Moteurs d'Aviation, Paris, France

[21] Appl. No.: 929,908

[22] Filed: Aug. 1, 1978

[30] Foreign Application Priority Data

Aug. 26, 1977 [FR] France ..... 77 26638

[51] Int. Cl.[3] ..... F01D 11/08

[52] U.S. Cl. ..... 415/116; 415/174

[58] Field of Search ..... 415/113, 116, 174, 117

[56] References Cited

U.S. PATENT DOCUMENTS

| | | | |
|---|---|---|---|
| 3,126,149 | 3/1964 | Bowers Jr. et al. | 415/174 |
| 3,146,992 | 8/1964 | Farrell | 415/136 |
| 3,365,172 | 1/1968 | McDonough et al. | 416/95 |
| 3,656,862 | 4/1972 | Rahaim et al. | 415/174 |
| 3,728,039 | 4/1973 | Plemmons et al. | 415/115 |
| 3,825,364 | 7/1974 | Halila et al. | 415/174 |
| 3,825,365 | 7/1974 | Peng | 415/116 |
| 3,834,001 | 9/1974 | Carroll et al. | 415/116 |

*Primary Examiner*—Everette A. Powell, Jr.
*Assistant Examiner*—A. N. Trausch, III
*Attorney, Agent, or Firm*—Bacon & Thomas

[57] ABSTRACT

A turbine housing for a jet engine is provided with a ring of an abradable porous material. A supporting and mounting device consisting of a cylindricoconical monoblock having a conical internal jacket provides for the convection cooling of the external surface and a cylindrical jacket for cooling air is held over the abradable ring by means of a perforated ferrule integral with the rest of the device. The abradable ring carries transverse partitions to prevent axial leakage.

10 Claims, 4 Drawing Figures

A
1
2
3
4
5
6
7
8
9
10
11
12
13
14
15
16
17
18
19
20
21
22
23
24
25
26
27
28

POROUS ABRADABLE SHROUD WITH TRANSVERSE PARTITIONS

BACKGROUND OF THE INVENTION

The invention concerns turbine housings for jet engines and more particularly rings placed at the periphery of turbine wheels and constituting part of the housing, said rings operating at elevated temperatures and being exposed to the abrasion caused by the tips of the rotating blades.

In a turboreactor, the value of the thrust produced is proportional both to the amount of air and the velocity of flow of the exhaust gas. The air flow originating in the compressor and the combustion chamber is directed onto the turbine blades mounted on rotating disks. The kinetic energy of the jet of gas is transformed by its passage through the blades into a rotational couple which moves the disks. The disks of the turbine are integral with a shaft connected with the inlet compressor. Because the output of the engine is due, in part, to the transfer of the kinetic energy of the flow of air to the turbine, it is important that all of the air should pass through the blades by eliminating leaks developing between the tips of the blades and the housing which surrounds them and which serves to outline the flow section. In view of the movement of the pieces and the elevated operating temperatures, it has not been possible to eliminate in a simple manner the space between the tips of the blades and the housing.

In order to reduce this space, if not completely eliminate it, numerous solutions have been proposed. According to a rather old solution, the housing was doubled by rings arranged to face each disk of blades. Because of the impossibility of maintaining the small tolerances between the tipes of the blades and the rings, a wear problem appeared, which was aggravated still more by the deformations produced by the elevated temperatures at which these parts operate. This leads to the cooling of the rings. In order to obtain an effective joint between the tip of the blade and the ring without wearing off the tip of the blades, a material wearing more readily than the material constituting the blades was used in the rings, the blades then forming a groove in the ring in which they rotate freely.

The initial honeycomb materials used in the rings allowed only impact cooling which was often inadequate and not very uniform. Transpiration cooling, i.e. by traversing the material with a coolant, can be used only with a low porosity material, because the amount of the cooling liquid must be kept as low as possible to avoid a reduction of the overall output of the reactor.

The need for low porosity lead to the making of the rings of porous sintered materials. The abrasion produced by the blades had as a corollary an important and uncontrollable variation of porosity so that cooling by transpiration could not be effected correctly.

U.S. Pat. No. 3,825,364 proposed a solution to this problem by using an abradable material consisting of two layers of sintered metal of different porosities. The material controlling the flow of the cooling liquid is the outer one with respect to the blades, while the material in contact with the blades has a high porosity so that it may be worn down by the blades without interferring with the passage of the cooling liquid toward the outside. The cooling of the ring alone cannot provide completely satisfactory results if its support itself is subject to thermal deformation. The housing and the device supporting the ring are cooled by a flow of air uniformly distributed through the openings of a jacket arranged at a small distance from the walls of the housing. The ring, made of the sintered material, is held in a support which leaves a space between the bottom of the support and the ring, said space being supplied with cooling air from the jacket, the air passing over the wall of the housing and then the bottom of the support.

The device according to the prior art represents an improvement with respect to previously used devices, but still leaves one non negligible cause of leaking untouched and if, theorectically, it may be considered that the space between the ring and the tips of the blades is reduced to a minimum, the same is not true in actual practice. In fact, due to the porosity of the material and the pressure differences which exist between the inlet and the outlet of the turbine, a part of the air flow of the reactor passes longitudinally in the layer of porous material, thus losing some of its kinetic energy not on the blades but in the porous material of the ring, and in the process it seriously interferes with the transpiration cooling. Further, the supporting and mounting device for the ring comprises a certain number of pieces which cooperate by acting as casings. This type of mounting represents a source of leaks of the cooling air and creates thermal barriers detrimental to the favorable isothermal state of the assembly.

SUMMARY OF THE INVENTION

It is the object of the present invention to eliminate the above disadvantages by providing a sintered porous material preventing any longitudinal leakage of the air flow of the reactor and any interference with the transpiration cooling of the engine, said material being shaped from upstream to downstream in the direction of the flow in the form of feed chambers which also produce cooling by impact. In addition, the supporting and mounting device of the ring in accordance with one characteristic of the present invention provides a uniform temperature distribution thus eliminating all thermal gradients which generate deformations.

The housing of the turbine of the jet engine according to the present invention comprises at least one abradable ring of a porous sintered material, said ring constituting at least a part of the housing surrounding the disks of the turbine which carry the blades, said ring being cooled, at least by transpiration, by the air distributed by means of a support and mounting device for the ring, and is characterized by the fact that the ring comprises partitions transverse to the axis of the turbine.

The housing of the turbine of the jet engine is further characterized by the fact that the device supporting and mounting the ring comprises a monoblock structure of cylindroconic revolution having an external cylindrical part, carrying means to mount it on the housing of the engine, a conical part extending from said external cylindrical part, a perforated cylindrical ferrule attached to the inside of the external conical part at its end, a conical jacket mounted by means of keys on the inside of the external conical part at a height lower than said external conical part, a perforated cylindrical jacket attached by means of keys over the entire axial length of the perforated cylindrical part, and a ring made of an abradable porous material mounted on the perforated cylindrical ferrule.

DESCRIPTION OF THE PREFERRED EMBODIMENTS

Figures 1, 2, 3, 4:
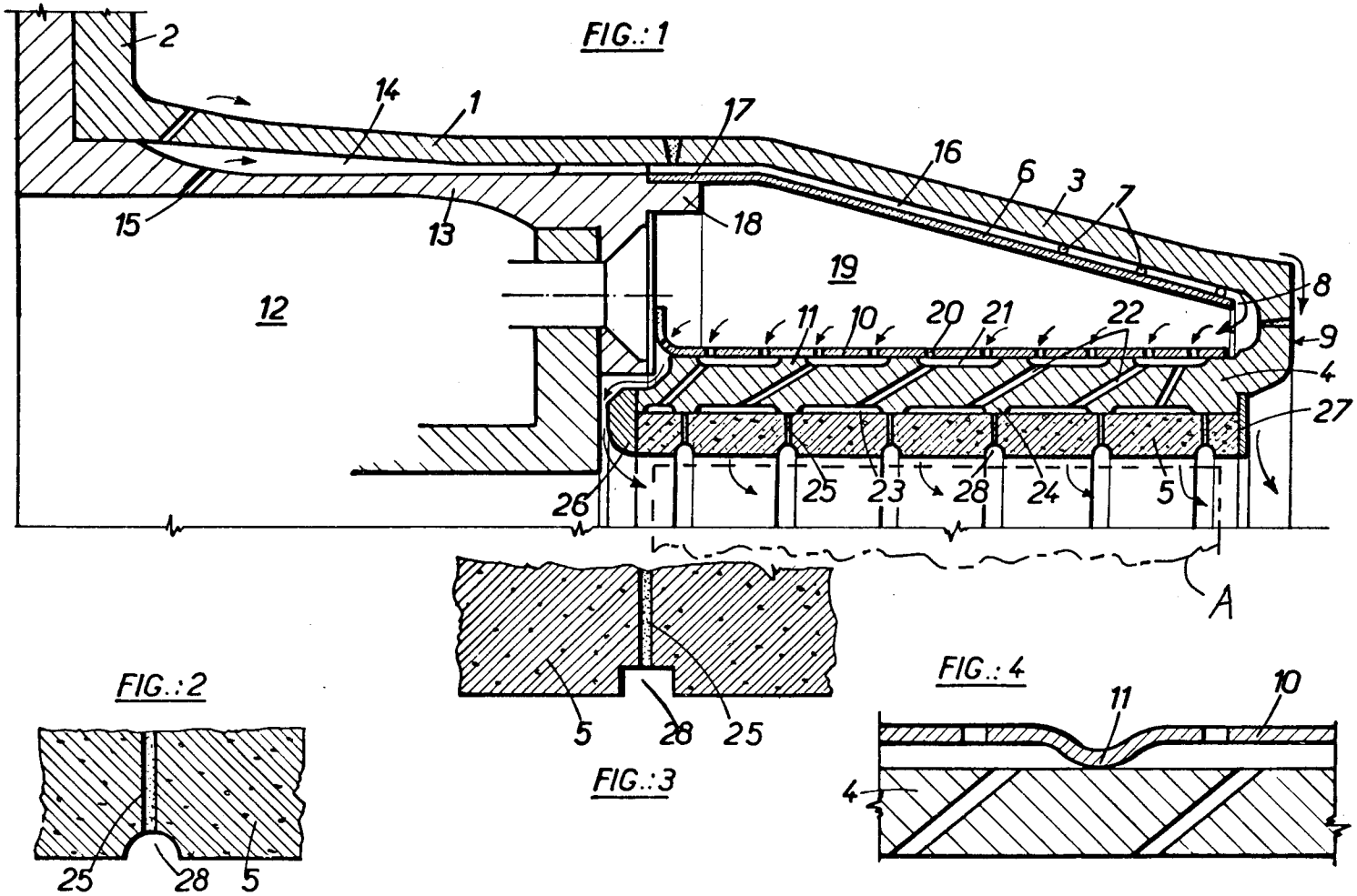
FIG. 1 is a longitudinal semi-section of an embodiment of a turbine housing according to the invention.
FIG. 2 is a form of embodiment of a ring defining partitions.
FIG. 3 is a second form of embodiment of a ring.
FIG. 4 is a form of embodiment of the keys.

The housing comprises a monoblock structure of cylindro-conic revolution, with an essentially uniform diameter, consisting of a substantially cylindrical external part 1, one end of which carries a mounting flange 2 to secure it to the turbine housing. The cylindrical part is extended rearwardly by a conical part 3. A perforated cylindrical ferrule 4 is inside the conical part 3 by being attached thereto at its rear end. This ferrule 4 supports a ring 5 made of an abradable porous material. On the inner face of the conical part 3, a jacket 6 is mounted, and held concentric to part 3, by means of keys or spacers 7 formed by balls. The diameter of said jacket is such that it leaves a passage 8 at its end 9, which forms the joint between the external conical part 3 and the ferrule 4. A cylindrical jacket 10 is secured by means of keys 11 to the outer face of the perforated ferrule 4.

According to one form of embodiment as shown, the structure described hereabove covers one part of the housing of a combustion chamber 12 and has dimensions such that it leaves an annular space 14 between itself and the wall 13 of the combustion chamber, which space is supplied with cooling air by means of the openings 15. The air is thus passed through the space 16 which separates the conical jacket 6 of the external part 3 and cools this part by convection. The jacket 6 is designed so that its front part 17 is secured to a rim 18 of the housing of the combustion chamber. The air then expands in the chamber 19 prior to passing through the openings 20 and 22 provided in the jacket 10 and ferrule 4. According to the embodiment shown, the keys or spacers 11, carried by the ferrule 4 and serving to mount the cylindrical jacket 10, consist of radial ribs provided on the outer face of the ferrule. These ribs define together with the perforated jacket annular chambers 21, said chambers uniformly distributing the cooling air. The channels defined by openings 22 open into the chambers, said channels being preferentially of an oblique configuration in order to provide a larger contact surface with the ferrule and the air. Said channels constitute means of communication between the annular chambers 21 and the annular chambers 23 which are formed in ferrule 4 directly against the ring 5 of porous material. The chambers 23 are shpaed in a manner similar to the chambers 21. Ribs 24 are thus provided on the inner surface of the ferrule 4 so that their position corresponds to the partitions 25 formed in the ring. The ring 5 is secured in a conventional manner. The ends of the ring are supported by the collars 26 and 27 mounted on the ends of the ferrule 4.

FIG. 4 shows a second form of embodiment of the keys 11 between the perforated cylindrical jacket 10 and the ferrule 4. The keys are formed by radial ribs produced in the jacket by die punching or embossing. The jacket is then attached to the ferrule for example by electric welding.

FIG. 2 is an enlarged section of a part of the ring 5, comprising a transverse partition 25 and in this particular case, a radial partition. This partition is obtained by exposing the ring of porous material to electron bombardment. Because of the small thickness of the abradable material, which is of the order of 3 to 5 mm, the electron beam readily produces fusion through the material but limited to a zone with a small width of the order of 0.5 mm.

FIG. 1 shows, as an extension of the partitions and on the inner surface of the ring, i.e. the surface adjacent to the vanes of the rotor, a groove 28.

According to the examples represented by FIGS. 2 and 3, this groove may be of semicircular or rectangular configuration. The semicircular configuration may be obtained during the production of the partitions by grooving the material at the entrance of the electron beam. This groove, produced by electron bombardment or by conventional machining, has two functions: to eliminate the widest part of the partition, and to prevent the marking of the vane (shown by dotted line at A in FIG. 1) when said vane comes into contact with the material and particularly with the partition.

Another solution consists of forming the partitions obliquely with respect to the axis of the ring so as to reduce the "cutting effect" at the apexes of the vanes.

As explained hereabove, pressures at the inlet and the outlet of the turbine are at a ratio of at least 2. The air flow coming from the combustion chamber will pass more easily through the porous material than between the vanes. This leak would lead to the loss of a large portion of the advantages of the abradable material as a tight joint with the apexes of the vanes. By providing transverse partitions in the material, axial leaks are reduced, if not eliminated, in the material of ring 5. According to known embodiments, the porous abradable material consists either of sintered microspheres, or of "sponge" obtained by electrodeposition around microspheres which are dissolved after the electrodeposition thus forming a honeycomb structure. The continuous structure of the mounting device of a turbine ring provides uniform temperatures because of the absence of wall thickness variations and of attached pieces, the joints between different pieces often acting as thermal barriers.

The efficiency of the internal ventilation of the ring, together with the role as thermal insulation of the abradable material lead to the fact that the structure is at a uniform temperature and does not experience the potential variations of the temperature of the hot gases of the jet. This thermal control of the monoblock device allows control of radial dilatation, thus the clearance at the apexes of the vanes. The uniformity of the temperature of the ring also makes it possible to prevent deformations which would be detrimental to the control of said clearance.

We claim:

1. In a housing for a jet engine having turbine blades in said housing and a ring including an abradable portion of a sintered porous material surrounding said turbine blades and wherein said ring is cooled by transpiration of air therethrough, the improvement comprising:

said ring being provided with partitions within the material of the ring and extending therethrough transverse to the axis of said rotor.

2. A housing as defined in claim 1 wherein at least portions of said partitions are oriented obliquely with respect to the axis of said rotor.

3. A housing as defined in claim 1 wherein the partitions through said sintered material are zones of the material of said ring fused by electron bombardment.

4. A housing as defined in claim 1 wherein said sintered material is provided on its inner face with grooves at the ends of said partitions, said grooves being adjacent the apexes of said blades.

5. A housing as defined in claim 1 wherein said housing comprises a monoblock structure of a cylindroconical revolution, having an external cylindrical portion carrying means for securing it to the engine, a conical portion extending from said external cylindrical portion, a perforated cylindrical ferrule secured to the inside of the external conical part at one end and constituting a portion of said ring supporting said sintered material, a conical jacket secured by spacers to the inside of the external conical part and spaced inwardly therefrom, and a perforated cylindrical jacket secured by spacers over said ferrule.

6. A housing as defined in claim 5 wherein said last-named spacers consist of radial ribs on said ferrule.

7. A housing as defined in claim 5 wherein said last-named spacers consist of radial ribs on said perforated cylindrical jacket.

8. A housing as defined in claim 6 wherein said ribs are secured to the sintered material in line with its partitions.

9. A housing as defined in claim 5 wherein the perforations of said ferrule extend oblique to the axis of said rotor.

10. A housing as defined in claim 5 wherein said first-named spacers are spheres.

* * * * *